United States Patent [19]

Verner

[11] Patent Number: 4,972,293

[45] Date of Patent: Nov. 20, 1990

[54] CODED ELECTROMAGNETIC DEVICE AND SYSTEM THEREFOR

[75] Inventor: Douglas R. Verner, Sterling Heights, Mich.

[73] Assignee: Allied-Signal Inc., Morris Township, Morris County, N.J.

[21] Appl. No.: 387,193

[22] Filed: Jul. 31, 1989

[51] Int. Cl.[5] ..... H01H 47/28

[52] U.S. Cl. ..... 361/187; 123/480; 364/431.05

[58] Field of Search ..... 361/88, 170, 187; 123/472, 478, 480; 207/10.6; 324/62, 67; 364/482, 431.05

[56] References Cited

U.S. PATENT DOCUMENTS 4,402,294 9/1983 McHugh et al. ..... 123/480
4,618,908 10/1986 Anttila ..... 361/187
4,792,905 12/1988 Sekozawa et al. ..... 123/480 X

*Primary Examiner*—Derek S. Jennings

[57] ABSTRACT

A code system for a device (30) that exhibits an input-output relationship characterized by an off-set and substantially linear performance (gain) comprising a resistor network (20) in cirucit with the device's coil (22), indicative of the device's GAIN and OFF-SET wherein the values of GAIN and OFF-SET are intrinsically coded within the value of a single resistor.

16 Claims, 2 Drawing Sheets

FIG. 1
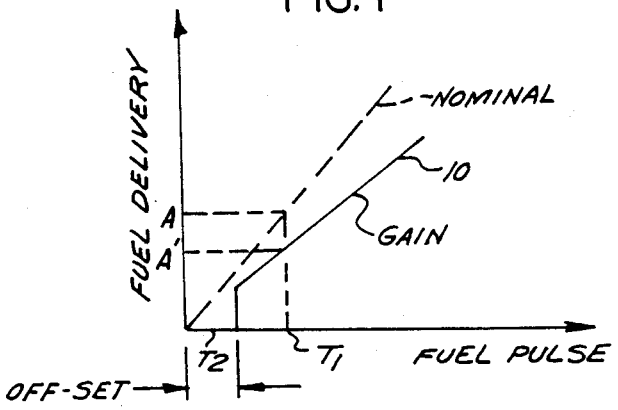
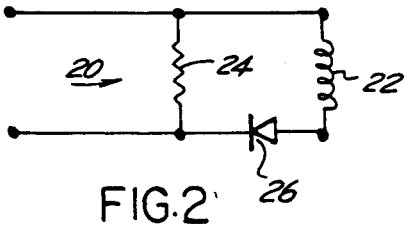
FIG.2
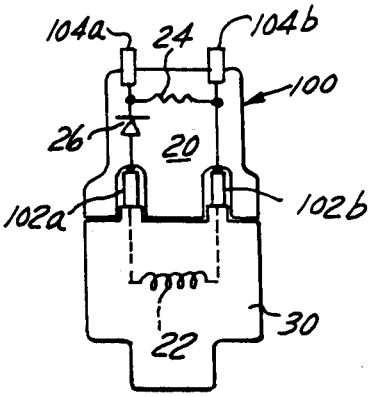
FIG.5
| | |
|---|---|
| 0 | 500 |
| 1 | 700 |
| 2 | 200 |
| – | – |
| – | – |
| – | – |
| – | – |
| 7 | 355 |
| 8 | 240 |
| 9 | 160 |
FIG.3
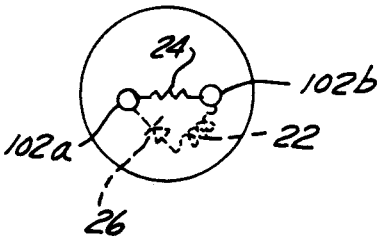
FIG.6

CODED ELECTROMAGNETIC DEVICE AND SYSTEM THEREFOR

The present invention relates to an actuator, such as a fuel injector which carries a personal code indicative of its offset and gain so that upon incorporation of such device into an engine and associated fuel system. The performance of the fuel system can be customized by using to the particular offset and gain codes.

Electronic fuel injection systems include at least one fuel injector responsive to a pulsed control signal generated from an electronic control unit (ECU). Ideally the amount of fuel injected into the engine is in proportion to the duration of the control pulse or in proportion to its duty cycle. Implicit in the operation of a multi-cylinder fuel injected system is that each fuel injector is substantially identical. This is true since the ECU contains information which is based upon a nominal fuel injector such that for a given pulse or duty cycle, this nominal injector will deliver a specified quantity of fuel in response to varying vehicle and engine dynamics. To achieve a minimum deviation from the norm, fuel injectors are manufactured to very exacting tolerances thereby increasing the cost of the fuel injector and most often times requiring testing of each fuel injector prior to its qualification. Fuel injectors which deviate from the norm are rejected and/or reworked In a general sense, systems that employ a plurality of electromechanical or electromagnetic actuators are based upon the assumption that the performance of each actuator is identical. The present invention to applicable to a broad range of such devices.

It is the object of the present invention to provide an electromechanical or electromagnetic device with a personal code from which may be extracted information regarding its GAIN AND OFF-SET. A further object of the present invention is to provide means for measuring or reading this personal code and transmitting same to a controller such as an ECU to enable the ECU to modify the nominal control signal for each device to optimize system performance, and in the particular case of a fuel injector to optimize duel delivery and engine performance.

Accordingly, the invention comprises a code system for devices including fuel injectors comprising a resistor network in circuit with an associated coil, such code being indicative of the device's GAIN and OFF-SET. The code system being physically attached, added or imbeded in a portion of the fuel injector interrogatable by an ECU such that the ECU, after reading the personal code for each fuel injector is capable of adjusting a nomimal fuel pulse to each injector in response to the resistive value of the resistor network to customize fuel delivery and compensate for the less than perfect attributes of the fuel injector In the present invention the code for each fuel injector is read prior to the initiation of fuel delivery to and activation of the fuel injectors. Ideally, the reading or interrogation and the storing of the code can be done during the first time the engine or system is turned on. This would be satisfactory in most cases except in the situation where such device is changed. As such, the system can be activated each time the engine is turned on. After the code has been received by the ECU the portion of the system which enables the reading of the code can be deactivated and the normal fuel delivery and activation systems enabled. The invention also extends to a method of implementing the code such method would include the following steps: (a) measuring the relationship of commanded to actual fuel delivered to establish a GAIN and OFF-SET function, (b) attaching a control resistor(s) to the injector have a resistance value that corresponds to the values of both the GAIN and OFF-SET; (c) installing such modified injector into an engine; (d) measuring the value of the control resistance, (e) enabling the normal operation of the injector and fuel system and (f) generating a normal control signal to the installed injector and modifying same in accordance with its corresponding GAIN and OFF-SET.

Many other objects and purposes of the invention will be clear from the following detailed description of the drawings

Brief Description of the Drawings

In the drawings:

FIG. 1 is a graph illustrating fuel injector performance.

FIG. 2 illustrates a means for implementing a personal code.

FIG. 3 is an exemplary table of control resistor values.

FIG. 5 illustrates a means for adding the control resistor to an injector.

FIG. 6 illustrates an alternate embodiment of the invention.

Detailed Description of the Drawings

Figure 4:
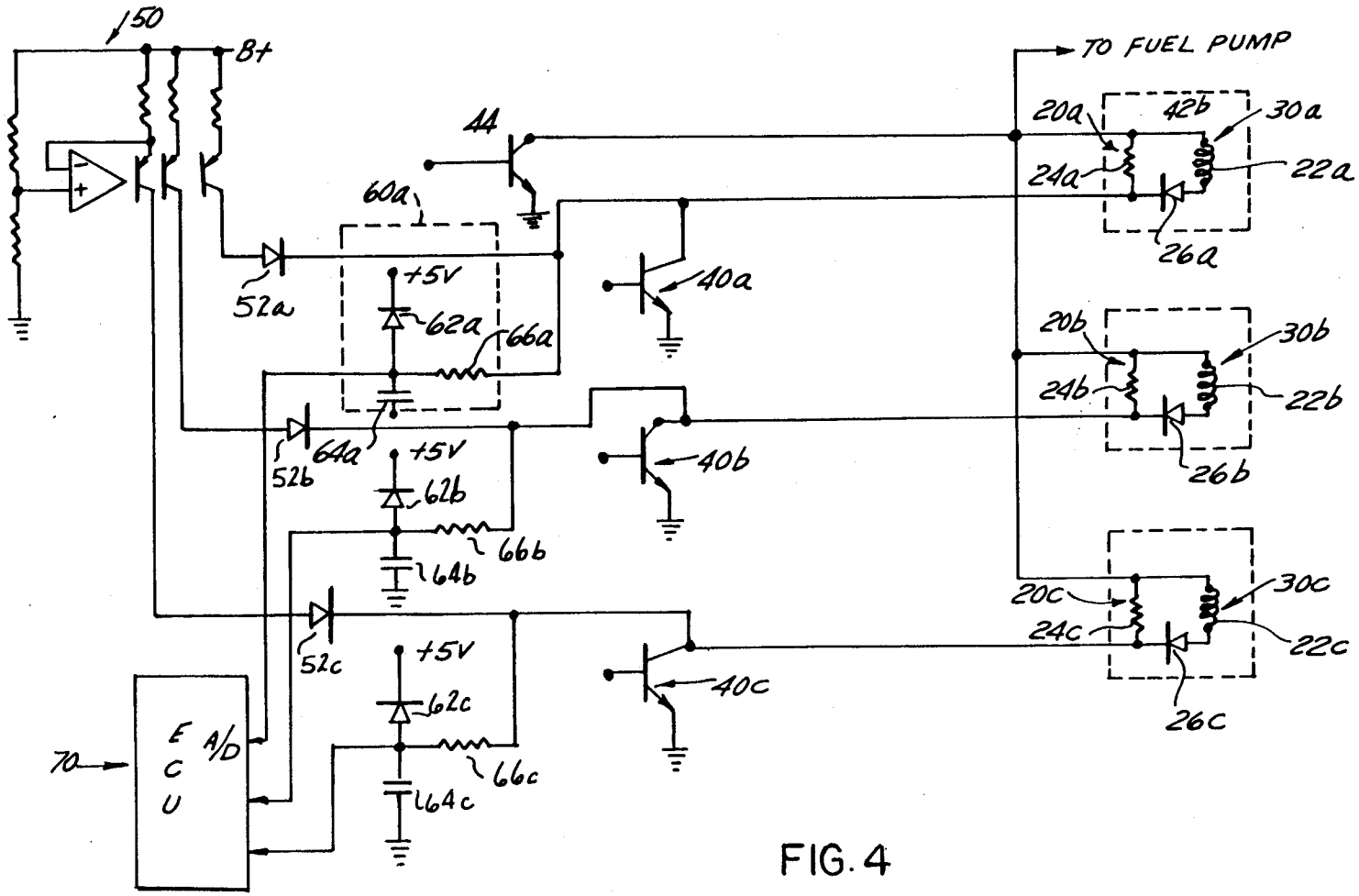
FIG. 4 illustrates a circuit for carrying out the present invention.

FIG. 1 is a graph illustrating fuel injector performance, such graph being illustrative of the performance of many solenoid actuated devices. In this particular case the horizontal scale is illustrative of fuel pulse width or duty cycle and the vertical scale illustrative of fuel delivery. For a nominal (ideal) fuel injector (shown in dotted line) the relationship between fuel pulse and fuel delivery is linear (GAIN) having zero OFF-SET. As is known in the art, the commanded fuel pulse, or generically a command sugnal, is generated by an ECU (not shown) in a manner to generate what is believed to be a predetermined quantity of fuel to match to engine load and speed requirements. In reality fuel injectors cannot be manufactured with the ideal fuel pulse/fuel delivery linear characteristic. In practice, the actual fuel pulse/fuel delivery function is shown by line 10 which may include a substantially linear (GAIN) portion which may differ from nominal as well as an OFF-SET portion for which no fuel (or motion in a typically solenoid valve) is delivered below a given pulsewidth. For example, under certain load and speed conditions, the ECU will generate a pulsewidth T1 which will cause the actual fuel injector to deliver a quantity of fuel designated as A'. The actual fuel delivered by the fuel injector will be in error (from the amount of fuel which the ECU assumes will be delivered to the engine) by an amount (A-A') causing a modest perturbation in engine performance. This modest, per injector, perturbation is amplified when one considers the additional perturbations resulting from the off-nominal performance of all the fuel injectors within the engine. As mentioned above this off-nominal performance has in the past been at least partially compensated for by manufacturing each fuel injector to exacting tolerances. As will be appreciated from the description below, the present invention unifies the performance of these so called tight tolerance injectors and also permits injectors to be built and used with varying tolerances. In the past these injectors having varying tolerances have been discarded or at least remanufactured prior to their use.

If the commaned fuel pulse such as T2 falls within the OFF-SET range, the fuel injector will not deliver any fuel to the engine and again will generate perturbations in its performance. In fact the most noticeable engine perturbation most often occurs at a low speed/low load operating level which may fall within the fuel injector OFF-SET level.

During the manufacture of a typical high performance fuel injector in order to verify that the performance characteristics of injector fall within its specification, the injector is calibrated. During such calibration process the OFF-SET level (in terms of pulse width) and injector GAIN are determined. These values may be used in the present invention in the manner described below. The invention contemplates the addition of a resistor network generally shown as shown as 20 which will be added to the fuel injector in circuit with its coil 22. The resistor network 20 comprises a control resistor 24 positioned substantially in parallel with the coil and a diode 26 substantially in series with the coil 22. The code may be obtained directly from the value of the control resistor 24. For practical purposes as related in the associated circuit (see FIG. 4) described below, it is invisioned that the maximum value of the control resistor 24 will be limited to 10 K ohms. This value results from the fact the most ECU specify at maximum voltage input of 5 volts. However, if the allowable input voltage is raised the control resistor value can be increased. In this construction, the most significant digit, i.e. thousands value, of the resistor will be a value indicative of the fuel injector's actual GAIN while less significant digits, i.e. hundreds, tens and ones value, of the resistor will be indicative of the fuel injector's OFF-SET. FIG. 3 shows by way of illustration various values that a control resistor 24 may take. As an example, based upon the calibration of a particular fuel injector, a resistor having the value of 2.2 K ohms has been chosen to be sufficient to categorize the injector's GAIN and OFF-SET. As such the 2 K ohm portion of the resistor is indicative of injector GAIN and the 0.2 K ohm value of the control resistor is indicative of OFF-SET. From FIG. 3 it can be seen that the GAIN related value of the control resistor will vary from 0 to 9. It should be appreciated, however, that the actual gain of the fuel injector will not vary, in absolute terms, from 0 thru 9 and that the GAIN value of the controlled resistor is merely indicative of the actual fuel injector GAIN. The translation or scaling between the control resistor value to actual fuel injector GAIN may be accomplished within the associated ECU in conjunction with a look up table or the like by known mathematical procedures employed in electronic circuits. It should also be appreciated that the GAIN portion of the control resistor 24 may be indicative of fuel injector GAIN or indicative of a normalized gain i.e. GAIN (actual)/GAIN (ideal) or perturbation increment from nominal.

Reference is made to FIG. 4 which illustrates a circuit diagram for implementing the present invention. Shown are a plurality of electromechanical devices such as fuel injectors 30*a–c* having associated therewith a resistor network 20*a–c*. It should be appreciated that any number of injectors could be included in this circuit. Each resistor network comprises a control resistor 24*a–c* and diode 26*a–c*. Under normal fuel injector operation, absent the inclusion of the resistor network 20*a–c*, the family of fuel injectors 30 would be controlled by various injector driver circuits shown schematically as 40*a–c* which under control of the ECU would cause the fuel injector to activate in response to varying, though normal, control pulses received. Fuel would be delivered to the fuel injector in a known manner. In the present invention each injector driver such as 40*a* would be connected to one terminal 42*a* of the injector coil through diode 26*a* (the injector power supply is not shown, as its implementation is commonly known in the art). The other terminal of each fuel injector is connected to ground through a switch such as transistor 44. A constant current source 50 (of approximately 0.5 ampere) is provided having its respective outputs connected to a respective one of the junctions of a control resistor 20 and diode 26 associated with each of the fuel injectors 30*a–c*. Diodes 52*a–c* are used to isolate the current source from fuel injector excitation pulses during normal operation. Connected to the cathode of each diode 52 is a buffer circuit 60*a–c*. The output of which is communicated to an ECU 70. Typically the output of the buffer circuit such as 60*a* is an analog voltage which will be communicated to an internal analog-to-digital (A/D)converter integral with the ECU 70. A typical buffer circuit such as 60*a* comprises of series combination of diode 62*a* and capacitor 64*a*. The cathode of diode 62*a* is biased positively such as to limit the voltage applied to the ECU 70 at 5 volts. A resistor 66*a* is provided between the junction of the anode of diode 62*a* and capacitor 64*a* and the control resistor 24*a*. The resistor 66*a* provides for current limiting to diode 62*a* when operating normally. The transistor switch such as 44 is communicated to the fuel pump relay or other similarly situated mechanism to inhibit distribution of fuel to the injectors as described below.

During assembly of the engine fuel injectors 30 each having a control resistor 24 signifying its particular GAIN and OFF-SET are inserted into the engine. Upon initial start up of the engine, the ECU 70 is commanded to temporarily inhibit the normal operation of each injector driver 40 and power to the injectors. Delivery of fuel to each injector can be inhibited under control of the ECU or in the manner as described below. Simultaneous with the inhibiting of the injector drivers 40, the ECU will generate a Control signal to the switch 44 thereby grounding one terminal of the control resistor and injection coil 22. Having grounded the resistor a complete circuit has been formed wherein the constant current generated by the constant current source 50 flows through each control resistor 24*a–c*. The activation of switch 44 may also be used to deactivate fuel flow. Such constant current source reverse biases each diode 26*a* thereby effectively removing the fuel injector coil 22*a–c* from the circuit and sets up a voltage drop across the control resistor 24*a–c*. The value of this voltage drop being portional to the value of the control resistor which in turn includes the coded information regarding the GAIN and OFF-SET of each particular fuel injector 30*a–c*. As an example, with a 0.5 ampere constant current flowing through a 2.2 K control resistor, the resulting voltage is 1.1 volts. The 1 volt portion of the signal signifying GAIN and the 0.1 volt portion signifying OFF-SET. The analog voltage across each control injector 24 is converted to a digital word usable by the ECU 70. Upon receipt of the coded gain and OFF-SET information, the ECU deactivates transistor switch 44, and activates the injector drivers 40 thereby returning the fuel injectors 30 to their normal function and operation.

The ECU 70 now has stored therein information regarding the GAIN and OFF-SET of each particular fuel injector 30. As is known in the art such ECU 70 will generate a nominal, though varying, control signal defining the pulsewidth for a nominal fuel injector in response to engine load, speed, etc. Prior to the communication of the control signal to the injector, the ECU will use the previously stored GAIN and OFF-SET values for each fuel injector and modify such control pulse accordingly. The mechanism of impleting command signal or fuel pulse compensation, within the scope of the present invention, is not limited to any particular methodology. As an example, if the OFF-SET is greater than 50%, of a predetermined range, one could add a predetermined amount to the nominal control signal (i.e. lengthen the pulsewidth or number of pulses), if less substract. The control signal would be at "nominal" of the OFF-SET is in the middle of the predetermined range. With respect to GAIN, such compensation may be affected as a multiplier to the nomimal control signal. As such it can be seen once the GAIN and OFF-SET are determined for each device (fuel injector) it becomes a straight forward task to decide the most effective implementation for the ECU and control strategy employed.

FIG. 5 illustrates a means by which a personal code may be incorporated within a previously manufactured fuel injector 30. There is shown an auxiliary cap 100 that is adapted to fit about the terminals 102-*a* and 102-*b* of the fuel injector 30. The cap 100 itself includes an additional set of terminals 104*a* and 104*b*. Internally connected within the cap is a resistor network 20 comprising a control resistor 24 and diode 26. Upon insertion of the auxiliary cap 100 on to the terminals 102, such personal code has now been fixed to the injector 30. As mentioned above, the code i.e. GAIN and OFF-SET is determined from the prior calibration of the fuel injector 30. The GAIN and OFF-SET codes are then translated into a resistance value in a manner as described above. In production it is envisioned that a family of caps 100 each having a variety of codes will have previously been manufactured and that upon calibration of the fuel injector 30 a cap 100 having an equal or substantially equal resistor or code value to that of the calibrated fuel injector may be selected and installed on the injector. In the embodiment shown in FIG. 5 the auxiliary cap 100 extends upwardly from the fuel injector. The cap is shown in somewhat larger than actual size and can be made as compact as necessary.

FIG. 6 illustrates an alternate embodiment of the invention. During the fabrication of the terminal 102 assembly, the diode 24 and control resistor 22 can be manufactured as an intregral component of such terminal assembly. As such, the control resistor (or resistors) may lie exposed on the surface of the terminal assembly across terminals 102*a* and *b*. The diode 26 would be within the injector housing connected between the coil 22 and terminal 102*a*. Upon calibration of the fuel injector 30 the control resistor (or resistors) may be laser trimmed to inbed the precise personal code for this injector 30 therein. Subsequently, the trimmed control resistor 24 may be protected by a layer of potting compound or the like.

Many changes and modifications in the above described embodiment of the invention can, of course, be carried out without departing from the scope thereof. Accordingly, that scope is intended to be limited only by the scope of the appended claims.

I claim:

1. A code system for a device including a coil that exhibits an input-output relationship characterized by an off-set such as a dead-zone and substantially linear input-output relationship (gain) comprising a resistor network in circuit with the coil, indicative of the device's GAIN and OFF-SET.

2. The system as defined in claim 1 wherever the resistor network is readable by control means such as an ECU.

3. The system as defined in claim 2 wherein the resistor network comprises a control resistor substantially in parallel with the coil and diode in series with the coil.

4. The system as defined in claim 3 wherein under normal operation of the device it is driven by a drive circuit and wherein the system includes first means for temporarily inhibiting the normal operation of the device during periods when the resistance value is being read.

5. The system as defined in claim 4 wherein the system further includes, second means, operational during periods when the normal operation of the device is inhibited for reading the value of the control resistor and communicating same to the ECU.

6. The system as defined in claim 5 wherein the second means includes current source means for generating a constant current to the control resistor; and third means for communicating the voltage drop across the control resistor to the ECU.

7. The system as defined in claim 6 further including means for protecting the current source means and ECU from voltage spikes generated by the device during its normal operation.

8. The system as defined in claim 1 wherein the resistance network includes a single resistor and wherein the value of the resistor corresponds to both the GAIN and OFF-SET.

9. The system as defined in claim 2 wherein the device as a fuel injector.

10. The system as defined in claim 9 wherein the controller means includes means for temporarily deactivating the drive circuit as well as disabling fuel delivery to the fuel injector.

11. A method of operating a device such as a fuel injector whose performance is characterized by GAIN and OFF-SET values comprising the steps of:

(a) measuring the relationship of commanded signal and output to establish the GAIN and OFF-SET values;

(b) attaching a control resistor to the device have a resistance value that corresponds to the values of both the GAIN and OFF-SET;

(c) installing such device in its normal operational environment;

(d) measuring the value of the control resistor corresponding to a particular device, (e) enabling the normal operation of the installed device;

(f) generating a control signal to the device wherein such control signal is proportional to the value of GAIN and OFF-SET as determined from the resistance value.

12. The method as defined in claim 11 including the step of choosing the control resistor in a manner such that a most significant digit or digits of the resistance value of the control resistor is indicative of GAIN and the less significant digit or digits is indicative of OFF-SET.

13. The method as defined in claim 12 wherein the step of chosing includes choosing a control resistor wherein the thousands (1000s) digit is indicative of GAIN and the lesser digits indicative of OFF-SET.

14. The method as defined in claim 11 is a fuel injector and wherein the step of measuring includes measuring the relationship between command signal and actual fuel delivered.

15. The method as defined in claim 11 wherein the step of attaching includes attaching the control resistor in circuit with a coil of the injector.

16. The method as defined in claim 11 wherein the step of measuring includes acquiring a signal indicative of the value of the control resistor.

* * * * *